US008424214B2

(12) United States Patent
Vanderbeek et al.

(10) Patent No.: US 8,424,214 B2
(45) Date of Patent: Apr. 23, 2013

(54) PLANE BLADE ADJUSTMENT IMPROVEMENT

(75) Inventors: Karl Vanderbeek, New Haven, CT (US); Keith M. Lombardi, Avon, CT (US)

(73) Assignee: Stanley Black & Decker, Inc., New Britain, CT (US)

( * ) Notice: Subject to any disclaimer, the term of this patent is extended or adjusted under 35 U.S.C. 154(b) by 0 days.

(21) Appl. No.: 13/041,690

(22) Filed: Mar. 7, 2011

(65) Prior Publication Data

US 2011/0146088 A1 Jun. 23, 2011

Related U.S. Application Data

(62) Division of application No. 11/984,061, filed on Nov. 13, 2007, now Pat. No. 7,937,842.

(51) Int. Cl.
*B27G 17/02* (2006.01)

(52) U.S. Cl.
USPC ..... 30/488; 30/487; 30/489

(58) Field of Classification Search ..... 30/478, 30/481, 484, 487, 48, 489
See application file for complete search history.

(56) References Cited

U.S. PATENT DOCUMENTS

| | | | |
|---|---|---|---|
| 306,877 | A | 10/1884 | Traut |
| 311,136 | A | 1/1885 | Mead |
| 421,850 | A | 2/1890 | Barker |
| 423,424 | A | 3/1890 | Frisbie |
| 516,413 | A | 3/1894 | Traut |
| 556,835 | A | 3/1896 | Smith |
| 680,055 | A | 8/1901 | Marks |
| 749,827 | A | 1/1904 | Sjolander |
| 763,721 | A | 6/1904 | Carleton et al. |
| 831,153 | A | 9/1906 | Glans |
| 1,090,225 | A | 3/1914 | Page |
| 1,417,857 | A | 5/1922 | Pfeiffer |
| 1,439,207 | A | 12/1922 | Vaughan |
| 1,459,206 | A | 6/1923 | Hardinge |
| 1,510,295 | A | 9/1924 | Brander et al. |

(Continued)

FOREIGN PATENT DOCUMENTS

| | | |
|---|---|---|
| CH | 334740 | 12/1958 |
| DE | 36 05 894 | 8/1987 |

(Continued)

OTHER PUBLICATIONS

Extended Search Report as issued for European Patent Application No. 08168808.7, dated Oct. 6, 2011.

*Primary Examiner* — Hwei C Payer
(74) *Attorney, Agent, or Firm* — Pillsbury Winthrop Shaw Pittman LLP

(57) ABSTRACT

A plane that includes a plane body having an opening positioned in a bottom surface of the plane body; an angled support structure carried by the plane body; a blade supported by the angled support structure, the blade having an edge positionable to protrude from the opening; a blade adjuster operatively connected with the blade; and a lateral stabilizer is provided. The lateral stabilizer is selectively adjustable to prevent or permit a lateral movement of the blade and the lateral stabilizer is configured to prevent lateral movement of the blade without preventing longitudinal adjustability of the blade. When the lateral stabilizer is configured to prevent lateral movement of the blade, the lateral stabilizer does not engage the blade.

30 Claims, 4 Drawing Sheets

U.S. PATENT DOCUMENTS

| | | | |
|---|---|---|---|
| 1,553,937 | A | 9/1925 | Fine |
| 1,696,584 | A | 12/1928 | Schwer |
| 1,726,124 | A | 8/1929 | Rodionoff |
| 1,823,383 | A | 9/1931 | Weller et al. |
| 2,423,713 | A | 7/1947 | Lavietes |
| 2,839,109 | A | 6/1958 | Wilson et al. |
| 3,028,892 | A | 4/1962 | Filia |
| 3,120,250 | A | 2/1964 | Dakin |
| 4,015,649 | A | 4/1977 | Gilbert |
| 4,088,165 | A | 5/1978 | Andersson |
| 4,498,513 | A | 2/1985 | Derivaz |
| 4,589,209 | A | 5/1986 | Zarges et al. |
| 5,694,696 | A | 12/1997 | Lee et al. |
| 6,615,497 | B1 | 9/2003 | Saunders et al. |
| 7,117,602 | B2 | 10/2006 | Saunders |
| 7,377,044 | B2 | 5/2008 | Economaki |
| 7,444,750 | B2 | 11/2008 | Saunders |
| 7,530,173 | B2 | 5/2009 | Economaki |
| 7,603,783 | B2 | 10/2009 | Lee et al. |
| 7,937,842 | B2 * | 5/2011 | Vanderbeek et al. ..... 30/488 |
| 2005/0060897 | A1 | 3/2005 | Saunders |
| 2005/0188553 | A1 | 9/2005 | Lee et al. |
| 2005/0229409 | A1 | 10/2005 | Lee et al. |
| 2006/0101653 | A1 | 5/2006 | Economaki |
| 2007/0044328 | A1 | 3/2007 | Economaki |
| 2009/0119936 | A1 | 5/2009 | Vanderbeek et al. |

FOREIGN PATENT DOCUMENTS

| | | |
|---|---|---|
| GB | 191311526 | 7/1913 |
| GB | 861363 | 2/1961 |
| GB | 2 000 714 | 1/1979 |

* cited by examiner

PLANE BLADE ADJUSTMENT IMPROVEMENT

CROSS-REFERENCE TO RELATED APPLICATIONS

This application is a divisional application of U.S. patent application Ser. No. 11/984,061, filed Nov. 13, 2007, now U.S. Pat. No. 7,937,842, the entire content of which is incorporated herein by reference.

BACKGROUND

The present disclosure generally relates to woodworking planes.

Woodworking planes have long been used to smooth the wood surface of a work piece. Such planes work when a woodworker pushes or pulls the plane across the wood surface. This allows a sharp blade of the plane to engage the wood surface and shear off a thin layer of wood, thereby smoothing the wood surface. The plane usually includes a plane body or blade holder, and a plane blade slightly protruding through an opening in the bottom surface of the plane body.

The plane blade may occasionally need to be adjusted, either longitudinally to control a cutting or planing depth, or angularly to adjust an angle of the blade relative to a bottom surface of the plane body (the cutting edge is typically maintained desirably along a line that is parallel to the bottom surface of the plane). The present disclosure provides a plane with an improved construction for enabling longitudinal and/or lateral adjustment of the plane blade.

SUMMARY

One aspect of the present disclosure provides a plane that includes a plane body, an angled support structure carried by the plane body, a blade supported by the angled support structure, a blade adjuster operatively connected with the blade, and a lateral stabilizer. The plane body has an opening positioned in a bottom surface of the plane body and the blade has an edge positionable to protrude from the opening. The blade adjuster longitudinally moves the blade so as to control a distance that the edge of the blade protrudes through the opening and laterally moves the blade so as to control an angle of the edge of the blade relative to the bottom surface of the plane body. The lateral stabilizer is selectively adjustable to prevent or permit a lateral movement of the blade. The lateral stabilizer is configured to prevent lateral movement of the blade without preventing longitudinal adjustability of the blade. When the lateral stabilizer is configured to prevent lateral movement of the blade, the lateral stabilizer does not engage the blade.

Another aspect of the present disclosure provides a plane that includes a plane body, an angled support structure carried by the plane body, a blade supported by the angled support structure, a blade adjuster operatively connected with the blade and a lateral stabilizer. The plane body having an opening positioned in a bottom surface of the plane body and the blade having an edge positionable to protrude from the opening. The blade adjuster longitudinally moves the blade so as to control a distance that the edge of the blade protrudes through the opening; and laterally moves the blade so as to control an angle of the edge of the blade relative to the bottom surface of the plane body. The lateral stabilizer is selectively adjustable to prevent or permit a lateral movement of the blade. The lateral stabilizer is configured to prevent lateral movement of the blade without preventing longitudinal adjustability of the blade. The lateral stabilizer includes a single adjustment structure which can be adjusted to prevent lateral movement of the blade.

Yet another aspect of the present disclosure provides a plane that includes a plane body, an angled support structure carried by the plane body, a blade supported by the angled support structure, a blade adjuster operatively connected with the blade and a lateral stabilizer. The plane body having an opening positioned in a bottom surface of the plane body and the blade having an edge positionable to protrude from the opening. The blade adjuster longitudinally moves the blade so as to control a distance that the edge of the blade protrudes through the opening; and laterally moves the blade so as to control an angle of the edge of the blade relative to the bottom surface of the plane body. The lateral stabilizer is selectively adjustable to prevent or permit a lateral movement of the blade. The lateral stabilizer is configured to prevent lateral movement of the blade without preventing longitudinal adjustability of the blade. The lateral stabilizer is adjustable to prevent any lateral movement of the blade without impacting ease of blade movement in the longitudinal direction.

These and other aspects of the present disclosure, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. In one embodiment of the present disclosure, the structural components illustrated can be considered are drawn to scale. It is to be expressly understood, however, that the drawings are for the purpose of illustration and description only and are not intended as a definition of the limits of the present disclosure. It shall also be appreciated that the features of one embodiment disclosed herein can be used in other embodiments disclosed herein. As used in the specification and in the claims, the singular form of "a", "an", and "the" include plural referents unless the context clearly dictates otherwise.

BRIEF DESCRIPTION OF THE DRAWINGS

The present disclosure is illustrated with drawings which represent one of the embodiment in which the present disclosure may be practiced. It is to be understood that the principles and features of the present disclosure may be embodied in variant embodiments incorporating changes and adaptations by those skilled in the art. Accordingly the present disclosure is not deemed limited to the exact construction shown. All modifications and equivalents are intended to be within the scope of the present disclosure. In the accompanying drawings.

DETAILED DESCRIPTION OF THE ILLUSTRATED EMBODIMENTS

Figure 1:
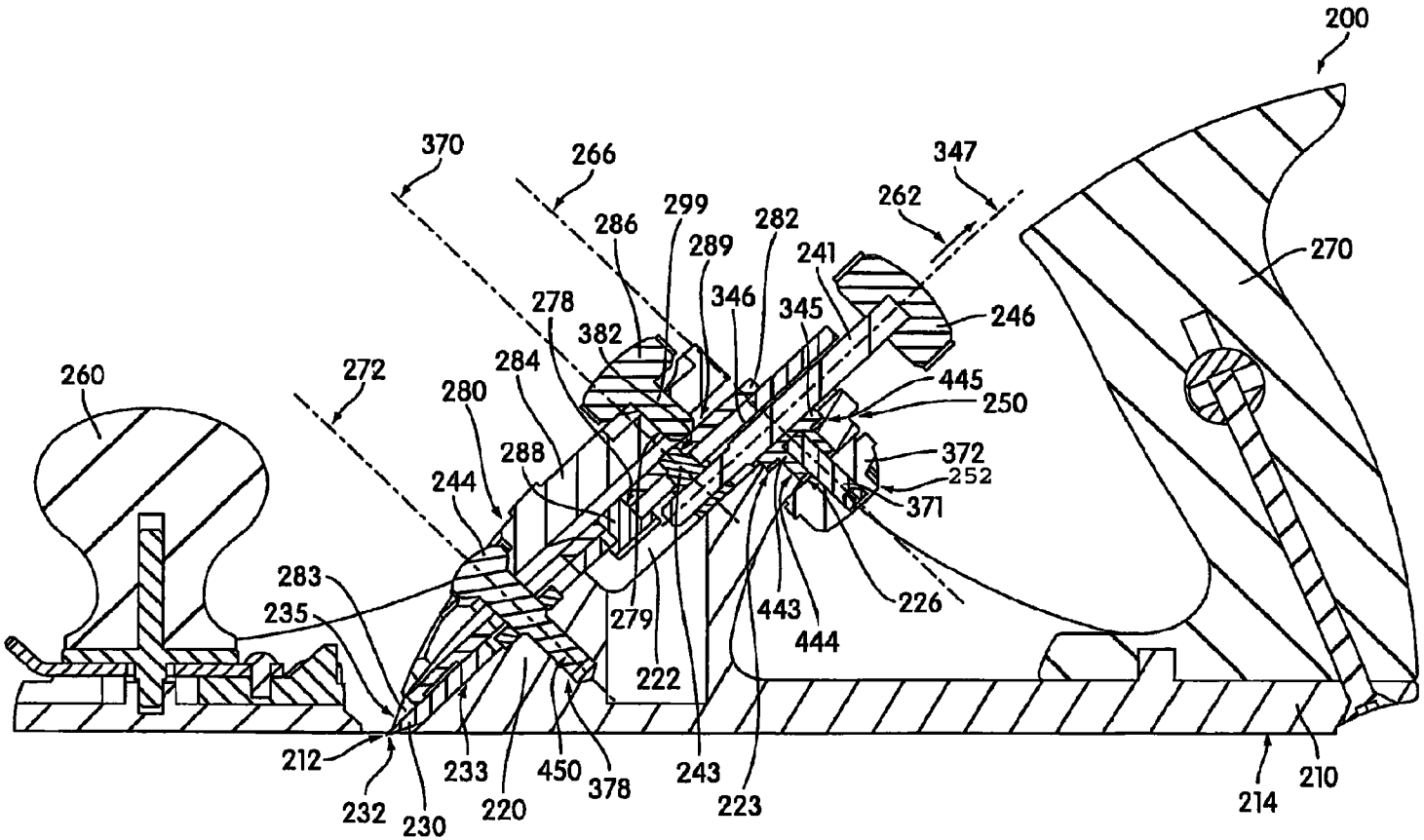
FIG. 1 illustrates a cross-sectional view of the plane in accordance with an embodiment of the present disclosure.

Reference is now made at FIG. 1 which illustrates a cross-sectional view of a plane 200 in accordance with an embodiment of the present disclosure. In one embodiment the plane 200 shown in FIG. 1 is a bench plane. The plane 200 comprises a plane body 210, an angled support structure 220, a plane blade 230, a blade adjuster 240, and a lateral stabilizer 250. The plane body 210, sometimes called a "sole," has an opening 212 positioned in a bottom surface 214 of the plane body 210. The angled support structure 220, sometimes called a "frog," is carried by the plane body 210 in either an integral or a detachable manner. The plane blade 230 may be placed against and therefore supported by an upper surface 231 of the angled support structure 220. The plane blade 230 has a cutting or planning edge 232 slightly protruding from the opening 212 to engage with the wood surface of a work piece. The blade adjuster 240 is operatively connected with the plane blade 230. Through a screwing or turning movement of knob 246, the blade adjuster 240 can longitudinally move and/or position the plane blade 230 so as to control a distance that the edge 232 of the plane blade 230 protrudes through the opening 212. This distance basically determines how deep the edge 232 of the plane blade 230 protrudes into the wood surface of the work piece and how thick the sheared-off wood tissue would be. The blade adjuster 240 can also pivotally move (about axis 266, shown in FIG. 1) so to angularly position the plane blade 230 (which pivots generally about axis 272 in FIG. 1) so as to control an angle of the edge 232 of the plane blade 230 relative to the bottom surface 214 of the plane body 210. This angle determines whether the depth of the edge 232 is uniform across the opening 212. The lateral stabilizer 250 is provided to apply an adjustable force to the plane blade 230, which force can effectively prevent or substantially inhibit the lateral movements of the plane blade 230 when the stabilizer 250 is fully engaged, while permitting a longitudinal movement of the plane blade 230, as will be discussed later in more detail. The plane 200 may also comprises a hand knob 260 and a tote 270. The hand knob 260 serves as a handle on the front of the plane body 210. The tote 270 serves as a handle on the rear of the plane body 210.

In one embodiment of the present disclosure, the angled support structure 220 or the frog is a wedge shaped casting integrally and permanently attached to the plane body 210. The plane 200 further comprises a blade securing mechanism 280 for securing the blade 230 to the angled support structure 220. The blade securing mechanism 280 comprises a chip breaker 282, a lever cap 284 and a thumb set screw 286. During the plane operation, the lower end 283 of chip breaker 282 generically functions to separate and remove the chips and shavings dislodged by the action of the plane blade 230 upon the work piece. The separation is performed by the action of an inclined surface 235 of the chip breaker 282 firmly secured at a position proximal to the edge 232 of the plane blade. The chip breaker 282 is firmly secured on top of the blade 230 via a blade screw 288. The blade screw 288 engages a thread 278 cut in the body of the chip breaker 282 such that the bottom surface of the chip breaker and the top surface of the plane blade 230 mutually engage in close surface contact exhibiting strong friction forces that effectively inhibit or prevent any relative movement between the blade 230 and the chip breaker 282 when the pressure caused by tightening of the blade screw 288 is applied. The lever cap 284 is positioned on top of the chip breaker 282 in such manner to provide additional support and tension to the chip breaker 282 and plane blade 230 assembly in the proximity of the edge 232 of the plane blade. The thumb set screw 286 has a threaded shaft 299 that is threadedly engaged in a threaded hole 279 bored through the lever cap 284 for sandwiching the chip breaker 282, and plane blade 230 assembly to the angled support structure 220. The thumb set screw 286 functions to adjust a friction force applied to the chip breaker 282 wherein a magnitude of the friction force determines how much rotational force must be applied to rotate knob 246 for making longitudinal depth adjustment to blade 230. Thus, set screw 286 is also referred to as a blade tensioner. The lever cap 284 is firmly attached to the angled support structure 220 and secured by tightening of a lever cap screw 244, which has a narrowed diameter threaded portion 450 received by a threaded bore 378 in the support structure 220. By tightening the thumb set screw 286, a tip end 289 of the thumb set screw 286 presses against the chip breaker 282 and, therefore, the blade 230 is additionally secured in its position by the frictional engagement between the bottom surface 233 of the plane blade 230 and the upper surface 231 of the angled support surface 220, as previously adjusted by the woodworker longitudinally and/or laterally.

Figure 2:
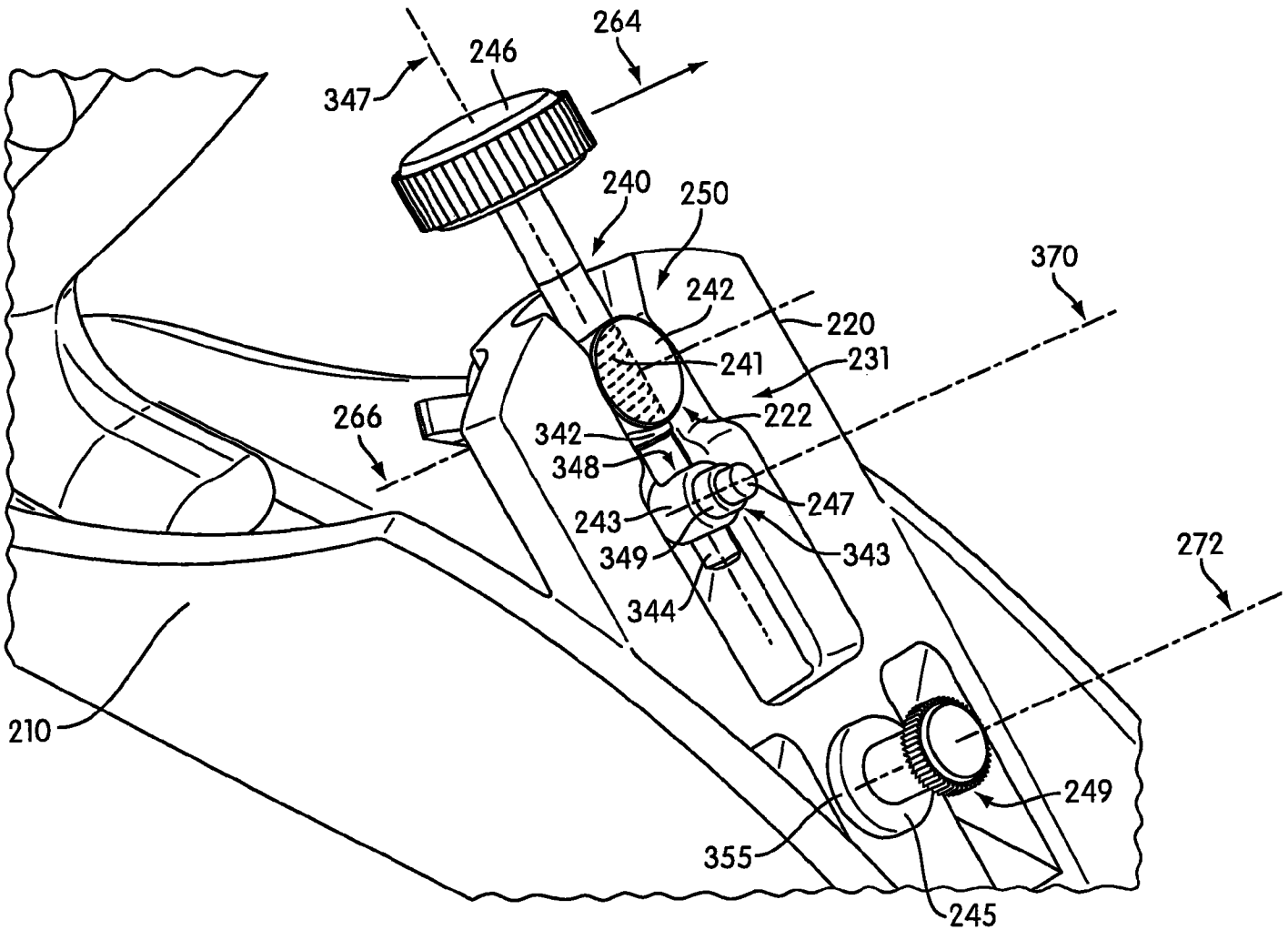
FIG. 2 illustrates a perspective view of the blade adjuster in accordance with an embodiment of the present disclosure.
Figure 3:
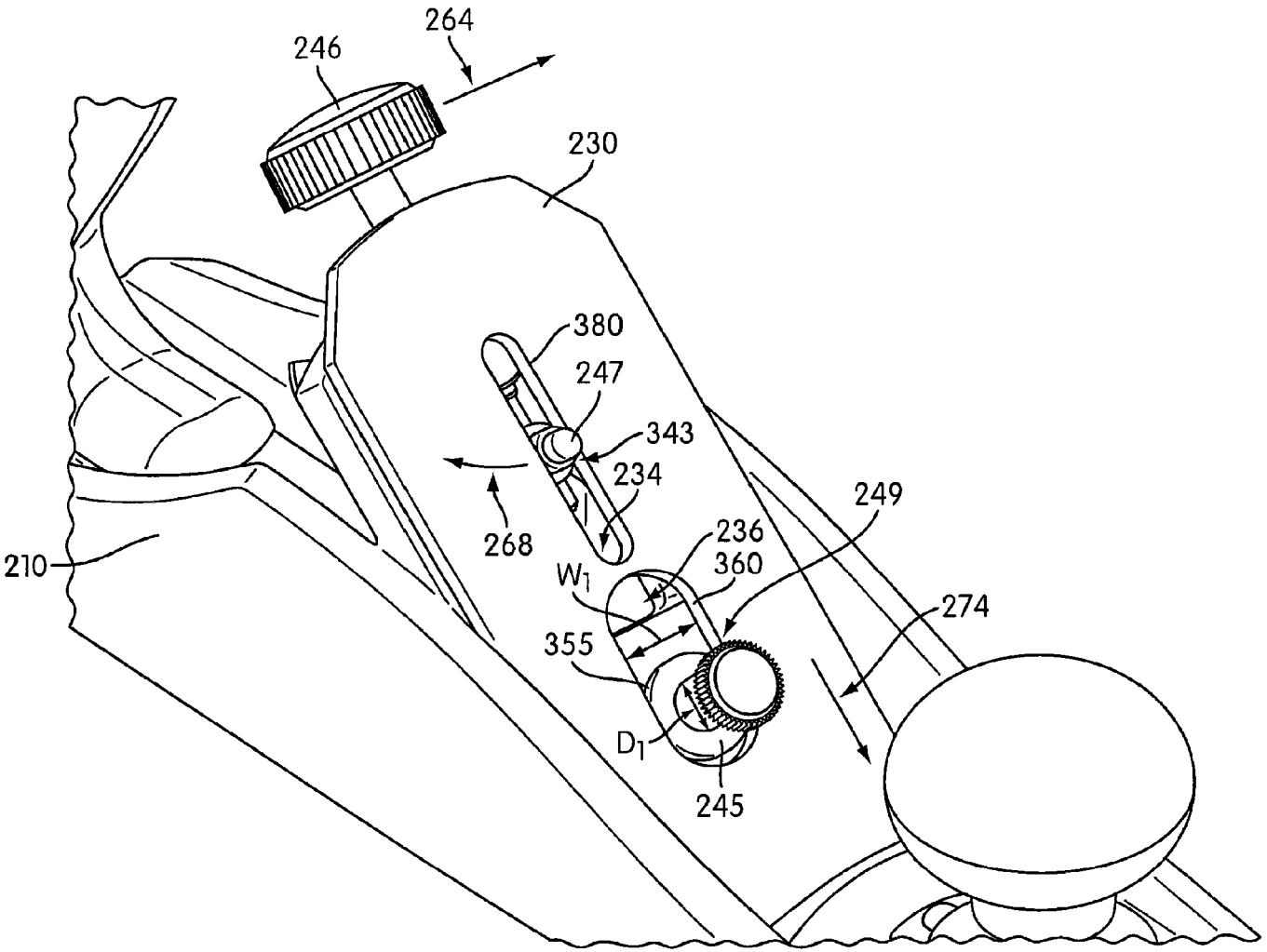
FIG. 3 illustrates a perspective view of the plane blade with the first engagement slot and the second engagement slot in accordance with an embodiment of the present disclosure.

FIG. 2 illustrates a perspective view of the blade adjuster assembly 240 in relation the angled support structure 220 in accordance with an embodiment of the present disclosure. FIG. 3 illustrates a perspective view of the plane blade 230 with the first engagement slot 234 and the second engagement slot 236 in accordance with an embodiment of the present disclosure. As shown in FIG. 2, the blade adjuster 240 may be considered to comprise structure that longitudinally moves the blade to control the distance that the blade extends through the opening 212 and that laterally moves the blade to control an angle of the edge of the blade relative to the bottom surface 214 of the plane body 210. In one embodiment, the blade adjuster 240 comprises a threaded adjustment rod 241 having the adjustment knob 246 connected to upper end thereof, pivot bushing 242, lateral adjustment bushing 243, and lever cap pivot assembly 249. The angled support structure 220 comprises a recess or opening 222 in the upper surface 231 of the angled support structure 220. The recess 222 can receive several components of the blade adjuster assembly 240, for example, the threaded adjustment rod 241, the pivot bushing 242, and the lateral adjustment bushing 243. The recess 222 contains therein a shaped receptacle 223 for receiving therein a rearward portion 443 of the pivot bushing 242. Specifically, the pivot bushing 242 has enlarged disk shaped upper portion 345 that has a threaded bore 346 therethrough (see FIG. 1), and a rearward projecting cylindrical shaped portion 443. The receptacle 223 has an enlarged upper disk shaped recess portion 445 to receive upper portion 345, and a cylindrical recess portion 444 to receive rearward portion 443.

The threaded adjustment rod 241 is generally positioned underneath the plane blade 230 (as shown in FIGS. 1 and 3) for adjusting the distance that the edge 232 of the plane blade 230 protrudes from the opening 212 on the bottom surface 214 of the plane body 210. The lateral adjustment bushing 243 and the adjustment knob 246 are generally located on the opposite end of the threaded adjustment rod 241. In one embodiment, the threaded adjustment rod 241 incorporates two threaded sections. The upper threaded section 342, closer to the adjustment knob 246 of the rod 241, is threaded with a right-handed helicity thread disposed to engage the corresponding threaded bore 346 in the pivot bushing 242. The lower threaded section 344, closer to the distal end of the adjustment rod 241 opposite from the adjustment knob 246, is threaded with a left hand helicity thread disposed to engage an appropriate threaded hole 348 in the lateral adjustment bushing 243. The longitudinal adjustment can be accomplished by rotating the adjustment knob 246 on one end of the threaded adjustment rod 241 around the axis 347. Rotation of the adjustment knob 246 in a clockwise direction (as observed from the adjustment knob end of the threaded adjustment rod 241) will cause the threaded adjustment rod 241 to travel in the longitudinal direction 262 through the pivot bushing 242 toward the opening 212, and at the same time, pushing the lateral adjustment bushing 243 in the same direction. The pivot bushing 242 can not translate in longitudinal direction 262 with respect to the recess 222 or receptacle 223, and can receive the threaded adjustment rod 241 through a threaded channel or a threaded rod bore 346 inside the pivot bushing 242.

In a different embodiment, the threaded adjustment rod 241 comprises only one threaded section threaded with a right-handed helicity thread disposed to engage the corresponding threaded bore 346 in the pivot bushing 242. The lateral adjustment bushing 243 is connected closer to the distal end of the adjustment rod 241 opposite from the adjustment knob 246, using a connector that allows for free rotation of the threaded adjustment rod 241 relative to the lateral adjustment bushing 243, but not any relative translation of the bushing 243 along the rod 241. In this embodiment, the translation of the rod 241 caused by the rotation of the knob 246 will transport the bushing 243 in the desired direction along the axis 347. For example, rotation of the adjustment knob 246 in a counter-clockwise direction (as observed from the adjustment knob end of the threaded adjustment rod 241) will cause the threaded adjustment rod 241 to travel in the longitudinal direction 262 through the pivot bushing 242 pulling the lateral adjustment bushing 243 away from the opening 212.

In yet another embodiment, the threaded adjustment rod 241 includes only one threaded section, threaded with a left-handed helicity thread, disposed to engage an appropriate threaded hole 348 in the lateral adjustment bushing 243, while the threaded adjustment rod is arranged to include a connector that allows for free rotation of the threaded adjustment rod 241 relative to the pivot bushing 242, but not any relative translation of the pivot bushing 242 along the rod 241. In such embodiment, the rotation of the knob 246 will transport the lateral adjustment bushing 243 in the desired direction along the axis 347. For example, rotation of the adjustment knob 246 in a clockwise direction (as observed from the adjustment knob end of the threaded adjustment rod 241) will cause the lateral adjustment bushing 243 to travel toward the opening 212 along the threaded adjustment rod 241, which does not translate relative to the pivot bushing 242.

It should be noted that embodiments employing different threads with helicities different from those disclosed above are also possible and considered to be different embodiments of the present disclosure.

To facilitate the longitudinal and/or lateral adjustment of the blade via the blade adjuster 240, the blade 230 also comprises the first engagement slot 234 and the second engagement slot 236 as shown in FIG. 3. The lateral adjustment bushing 243 further comprises an engagement pin portion 247 positioned on top of a blade engagement cylinder portion 343. The cylinder portion 343 has a cylindrical surface 349 positioned within and engaging with the first engagement slot 234 in the plane blade 230 in such way that the edges 380 of the first engagement slot 234 that engages the cylindrical surface 349 can rotate around a cylindrical axis 370 experiencing negligible intensity of fictional forces. The engagement pin 247 is disposed to fit a corresponding opening 382 in the body of the chip breaker 282 which allows for rotation of the engagement pin 247 around the cylindrical axis 370, but not any perceptible relative translational motion generally in the longitudinal direction 262 between the engagement pin 247 and the chip breaker 282 and plane blade 230 assembly. The lever cap pivot assembly 249 comprises lever cap screw 244 and lever cap bushing 245. Screw 244 has threads 450 positioned to engage the threaded bore 378 drilled and threaded in the support structure 220 such that when the lever cap screw 244 is inserted in the threaded bore 378, the axis of symmetry of the entire lever cap pivot assembly provides a stable axis of rotation for the plane blade 230. The lever cap pivot assembly 249 is placed within and engages with the second engagement slot 236 on the plane blade 230. As shown in FIG. 3, the portion of the lever cap screw 244 which protrudes through the second engagement slot 236 generally has a diameter (D1), which is narrower than a width (W1) of the second engagement slot 236 of the plane blade 230. The lever cap bushing 245 is positioned around the lever cap screw 244 to fill the gap caused by the difference between D1 and W1. The lever cap bushing 245 comprises an outer cylindrical surface 355 in contact with the edges 360 of the second engagement slot 236 in such manner that the plane blade 230 can rotate around an axis 272 through screw 244 experiencing negligible frictional force. Therefore, due to the engagement function served by the lever cap bushing 245, a second axis 272 is provided for the plane blade 230 pivot around. It is noted, however, that the diameter (D1) of the protruding portion of the lever cap screw 244 need not be narrower than the width (W1) of the second engagement slot 236.

Figure 4:
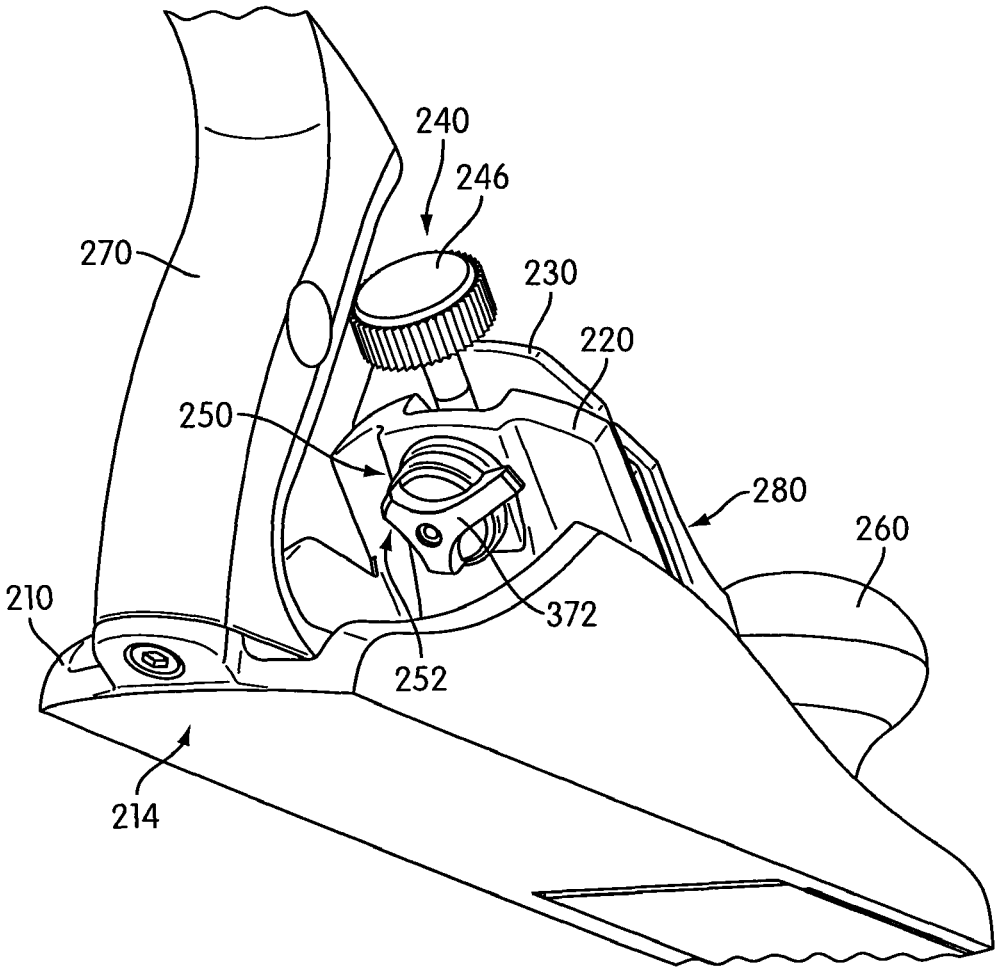
FIG. 4 illustrates a perspective view of the lateral stabilizer in accordance with an embodiment of the present disclosure.

FIG. 4 illustrates a perspective view of the plane with the lateral stabilizer 250 in accordance with an embodiment of the present disclosure. In one embodiment of the present disclosure, the lateral stabilizer 250 inhibits a lateral movement of the plane blade 230 while still permitting a longitudinal movement of the plane blade 230. As seen in FIG. 1, the lateral stabilizer 250 comprises a lock screw assembly 252 with a shaft 371 fixedly connected to a knob 372, and threaded in at one opposite end to the thread inside of cylindrical portion 443 of pivot bushing 242. The pivot bushing 242 is accessible through an opening in the bottom surface 226 of the angled support structure 220. When the lock screw assembly 252 is tightened by rotating knob 372 clockwise, a rearward surface of the rearward portion 443 of the pivot bushing 242 is drawn rearwardly against the corresponding surface on the receptacle 223. The applied pushing force distributed over limited contact area between the receptacle 223 and the rearward portion 443 induces a high pressure resulting in significant frictional forces between the pivot bushing 242 and the angled support structure 220. The frictional forces effectively lock the pivot bushing 242 to prevent any rotation of the pivot bushing 242 around the axis 266. Thus, the knob 246 and its associated rod 241 cannot be pivoted about axis 266, which prevents lateral (or arcuate) movement of lateral adjustment bushing 243 and hence prevents pivoting movement of the blade 230 and chip breaker 282 about pivot assembly 249. However, because of the rod bore 346, longitudinal movement of the plane blade 230 may be still permitted if the thumb set screw 286 and the lever cap screw 244 are left in positions which do not apply pressure on the chip breaker 282—plane blade 230 assembly, sufficient to result in friction forces that prohibit the longitudinal movement of the plane blade 230. Thus, using the lateral stabilizer 250 can avoid or inhibit lateral movement of the plane blade 230 when the lock screw assembly 252 is tightened. In this way, longitudinal adjustment of the plane blade 230 can be made separately and independently from the lateral adjustment.

When only longitudinal adjustments of the depth of protrusion of the plane blade edge 232 through the opening 212 is required or desired in some embodiments of the present disclosure, the woodworker who intends to use the plane 200 needs only to rotate the adjustment knob 246 of the threaded adjustment rod 241 around the axis 347. This rotation will cause controlled longitudinal motion of chip breaker 282—plane blade 230 assembly sufficient to achieve the desired longitudinal adjustments, while the tightened lateral stabilizer 250 prevents lateral blade edge movement. In other embodiments, the woodworker may want to release, at least in part, the pressure on the chip breaker 282—plane blade 230 assembly, most conveniently by appropriate relaxation of the tension applied to the thumb set screw 286, before the required or desired longitudinal adjustments of the depth of protrusion of the plane blade edge 232 through the opening 212, in order to allow for sufficiently smooth longitudinal motion of chip breaker 282—plane blade 230 assemblies driven by the rotation of the adjustment knob 246.

When the woodworker desires or requires adjustments that include modifications of the angle of the edge 232 of the plane blade 230 with respect to the bottom surface of the plane body 210, the woodworker releases tension on the lateral stabilizer 250 by loosening lock screw assembly 252 to allow for rotation of the pivot bushing 242 around the axis 266. Specifically, counter-clockwise movement of the knob 372 loosens the threaded engagement between shaft 371 and pivot bushing 242 to relieve fictional engagement between pivot bushing rear surface 391 and a butting surface of the support structure 220. Subsequent actuation of the adjustment knob 246 of the threaded adjustment rod 241 in the lateral direction 264 causes the plane blade to move laterally or "tilt" the angle with respect to the bottom surface 214 of the plane body 210. More specifically, when the woodworker laterally actuates the adjustment knob 246 in a direction 264, the pivot bushing 242 is pivoted around the axis 266. This causes the lateral adjustment bushing 243 and the engagement pin 247 thereon to move laterally in a direction 268. The engagement pin 247 further actuates the chip breaker 282, firmly attached to the plane blade 230, to move laterally in the direction 268 and pivot around the axis 370. Because the lever cap bushing 245 of the lever cap pivot assembly 249 is in sliding contact with the second engagement slot 236 and provides a well defined axis of rotation 272 for the plane blade 230, the plane blade 230 can pivot around the axis 272 of the lever cap screw 244. Consequently, a lower portion of the plane blade 230, carrying the edge 232, can simultaneously move laterally in a direction 274 and rotate with respect to the axis 272. In this way, the woodworker can adjust the angle or tilt of the edge 232 of the plane blade 230 relative to the bottom surface 214 of the plane body 210. When the desired or required angle of the edge 232 is achieved, the woodworker needs only to apply tension on the lock screw assembly 252 and lock the pivot bushing 242 preventing any further rotation or pivoting lateral motion. Any subsequent longitudinal adjustment can be performed, as disclosed above, without further need to repeat lateral adjustments iteratively.

It should also be appreciated that, if desired, the thumb set screw 286 and lateral stabilizer 250 can both be sufficiently loose to facilitate both longitudinal and lateral adjustment of the blade 230.

It should be appreciated that the terms lateral and arcuate movement of the blade (and lateral adjustment bushing 243) are used interchangeably herein, since the amount of movement is slight.

Although the present disclosure has been described in detail for the purpose of illustration, it is to be understood that such detail is solely for that purpose and that the present disclosure is not limited to the disclosed embodiments, but, on the contrary, is intended to cover modifications and equivalent arrangements that are within the spirit and scope of the appended claims. In addition, it is to be understood that the present disclosure contemplates that, to the extent possible, one or more features of any embodiment can be combined with one or more features of any other embodiment.

The invention claimed is:

1. A plane comprising:

a plane body having an opening positioned in a bottom surface of the plane body;

an angled support structure carried by the plane body;

a blade supported by the angled support structure, the blade having an edge positionable to protrude from the opening;

a blade adjuster operatively connected with the blade and that (i) longitudinally moves the blade so as to control a distance that the edge of the blade protrudes through the opening; and (ii) laterally moves the blade so as to control an angle of the edge of the blade relative to the bottom surface of the plane body; and a lateral stabilizer selectively adjustable to prevent or permit a lateral movement of the blade, wherein the lateral stabilizer is configured to prevent lateral movement of the blade without preventing longitudinal adjustability of the blade, wherein when the lateral stabilizer is configured to prevent lateral movement of the blade, the lateral stabilizer does not engage the blade, wherein the lateral stabilizer comprises a lock screw assembly positioned against a pivot bushing on the angled support structure, wherein the pivot bushing is constructed and arranged to pivot around a longitudinal axis of the lock screw assembly to permit the lateral movement of the blade, and wherein the pivotal movement of the pivot bushing around the longitudinal axis of the lock screw assembly is inhibited by a force applied by the lock screw assembly to prevent the lateral movement of the blade.

2. The plane according to claim 1, further comprising a blade tensioner that applies an adjustable force to the blade to adjust an amount of force that must be applied to the blade adjuster for making longitudinal movement of the blade.

3. The plane according to claim 2, further comprising a lever cap that applies a force to the blade in proximity to a planing edge of the blade.

4. The plane according to claim 3, wherein the blade tensioner comprises a set screw threadedly engaged with the lever cap.

5. The plane according to claim 4, further comprising a chip breaker secured to the blade.

6. The plane according to claim 5, wherein the set screw applies a blade tensioning force to the chip breaker.

7. The plane according to claim 1, wherein the lateral stabilizer applies an adjustable force to the blade adjuster to adjust an amount of the force that must be applied to the blade adjuster for effecting lateral movement of the blade.

8. The plane according to claim 7, wherein the blade adjuster comprises the pivot bushing, an adjustment rod threadedly received in the pivot bushing, and a lateral adjustment bushing operationally connected with the blade.

9. The plane according to claim 8, wherein rotation of the adjustment rod about its axis longitudinally moves the lateral adjustment bushing to effect longitudinal movement of the blade.

10. The plane according to claim 9, wherein pivotal movement of the adjustment rod about the pivot bushing moves the lateral adjustment bushing to effect lateral movement of the blade.

11. The plane according to claim 1, wherein the plane is a bench plane comprising a blade securing mechanism for securing the blade to the angled support structure, and the securing mechanism comprises:

a chip breaker secured to the blade;

a lever cap positioned on top the chip breaker; and a thumb set screw threadedly engaged with a threaded hole of the lever cap and applying a force to the chip breaker.

12. The plane according to claim 1, wherein the blade comprises a first engagement slot and a second engagement slot and the blade adjuster comprises:

a threaded adjustment rod positioned underneath the blade for adjusting, via an adjustment knob, the distance that the edge of the blade protrudes from the opening;

the pivot bushing for pivotally receiving the threaded adjustment rod through a rod bore; and a lateral adjustment bushing operatively connected with the threaded adjustment rod and disposed within the first engagement slot in the blade;

a lever cap pivot assembly disposed within the second engagement slot; and wherein when the threaded adjustment rod is pivoted about the pivot bushing upon the actuation of the adjustment knob, the lateral adjustment bushing actuates the blade via the first engagement slot, and the lever cap pivot assembly provides a pivot contact upon which the blade pivots so as to adjust the angle of the edge of the blade relative to the bottom surface of the plane body.

13. The plane according to claim 12, wherein the lever cap pivot assembly comprises:

a lever cap screw wherein a diameter of the lever cap screw is narrower than a width of the second engagement slot of the blade; and a lever cap bushing positioned around the lever cap screw for providing the pivot contact with the second engagement slot of the blade.

14. The plane according to claim 12, wherein when the lock screw assembly is tightened, the pivot bushing is pushed against the blade so that the lateral movement of the blade is inhibited while the longitudinal adjustability of the blade is permitted through the rod bore.

15. The plane according to claim 1, wherein the lateral stabilizer does not apply a frictional force that inhibits longitudinal movement of the blade.

16. The plane according to claim 1, wherein the lateral stabilizer has a single adjustment structure which can be adjusted to prevent lateral movement of the blade.

17. The plane according to claim 16, wherein the single adjustment structure is a knob.

18. The plane according to claim 1, wherein the lateral stabilizer is adjustable to prevent any lateral movement of the blade without impacting ease of blade movement in the longitudinal direction.

19. The plane according to claim 18, wherein the lateral stabilizer does not apply a frictional force that inhibits longitudinal movement of the blade.

20. A plane comprising:

a plane body having an opening positioned in a bottom surface of the plane body;

an angled support structure carried by the plane body;

a blade supported by the angled support structure, the blade having an edge positionable to protrude from the opening;

a blade adjuster operatively connected with the blade and that (i) longitudinally moves the blade so as to control a distance that the edge of the blade protrudes through the opening; and (ii) laterally moves the blade so as to control an angle of the edge of the blade relative to the bottom surface of the plane body; and a lateral stabilizer selectively adjustable to prevent or permit a lateral movement of the blade, wherein the lateral stabilizer is adjusted to prevent lateral movement of the blade without preventing longitudinal adjustability of the blade, wherein when the lateral stabilizer is adjusted to prevent lateral movement of the blade, the lateral stabilizer does not engage the blade wherein the lateral stabilizer comprises a threaded structure that applies an axial friction force to a pivot bushing to inhibit movements of the pivot bushing.

21. A plane comprising:

a plane body having an opening positioned in a bottom surface of the plane body;

an angled support structure carried by the plane body;

a blade supported by the angled support structure, the blade having an edge positionable to protrude from the opening;

a blade adjuster operatively connected with the blade and that (i) longitudinally moves the blade so as to control a distance that the edge of the blade protrudes through the opening; and (ii) laterally moves the blade so as to control an angle of the edge of the blade relative to the bottom surface of the plane body; and a lateral stabilizer selectively adjustable to prevent or permit a lateral movement of the blade, wherein the lateral stabilizer is configured to prevent lateral movement of the blade without preventing longitudinal adjustability of the blade, wherein the lateral stabilizer comprises a single adjustment structure which can be adjusted to prevent lateral movement of the blade and a pivot bushing on the angled support structure, the pivot bushing being operatively associated with the single adjustment structure, wherein the pivot bushing is constructed and arranged to pivot around a longitudinal axis of the single adjustment structure to permit the lateral movement of the blade, and wherein the pivotal movement of the pivot bushing around the longitudinal axis of the single adjustment structure is inhibited by a force applied by the single adjustment structure to prevent the lateral movement of the blade.

22. The plane according to claim 21, wherein when the lateral stabilizer is configured to prevent lateral movement of the blade, the lateral stabilizer does not engage the blade.

23. The plane according to claim 22, wherein the lateral stabilizer does not apply a frictional force that inhibits longitudinal movement of the blade.

24. The plane according to claim 21, wherein the single adjustment structure is a knob.

25. The plane according to claim 21, wherein the lateral stabilizer is adjustable to prevent any lateral movement of the blade without impacting ease of blade movement in the longitudinal direction.

26. A plane comprising:

a plane body having an opening positioned in a bottom surface of the plane body;

an angled support structure carried by the plane body;

a blade supported by the angled support structure, the blade having an edge positionable to protrude from the opening; a blade adjuster operatively connected with the blade and that (i) longitudinally moves the blade so as to control a distance that the edge of the blade protrudes through the opening; and (ii) laterally moves the blade so as to control an angle of the edge of the blade relative to the bottom surface of the plane body; and a lateral stabilizer selectively adjustable to prevent or permit a lateral movement of the blade, wherein the lateral stabilizer is configured to prevent lateral movement of the blade without preventing longitudinal adjustability of the blade, wherein the lateral stabilizer is adjustable to prevent any lateral movement of the blade without impacting ease of blade movement in the longitudinal direction, wherein the lateral stabilizer comprises a lock screw assembly positioned against a pivot bushing on the angled support structure, wherein the pivot bushing is constructed and arranged to pivot around a longitudinal axis of the lock screw assembly to permit the lateral movement of the blade, and wherein the pivotal movement of the pivot bushing around the longitudinal axis of the lock screw assembly is inhibited by a force applied by the lock screw assembly to prevent the lateral movement of the blade.

27. The plane according to claim 26, wherein when the lateral stabilizer is configured to prevent lateral movement of the blade, the lateral stabilizer does not engage the blade.

28. The plane according to claim 27, wherein the lateral stabilizer does not apply a frictional force that inhibits longitudinal movement of the blade.

29. The plane according to claim 26, wherein the lateral stabilizer has a single adjustment structure which can be adjusted to prevent lateral movement of the blade.

30. The plane according to claim 29, wherein the single adjustment structure is a knob.

* * * * *